US006843733B1

(12) United States Patent
Llewellyn et al.

(10) Patent No.: US 6,843,733 B1
(45) Date of Patent: Jan. 18, 2005

(54) CAVITY BACK GOLF CLUB HAVING A MULTI-TIERED WEIGHT DISTRIBUTION CONFIGURATION

(75) Inventors: David G. Llewellyn, Duluth, GA (US); Harry B. Taylor, Old Hickory, TN (US); Mamoru Saraie, Hirakata (JP)

(73) Assignee: Mizuno Corporation, Osaka (JP)

( * ) Notice: Subject to any disclaimer, the term of this patent is extended or adjusted under 35 U.S.C. 154(b) by 14 days.

(21) Appl. No.: 10/405,744

(22) Filed: Apr. 2, 2003

Related U.S. Application Data

(63) Continuation-in-part of application No. 29/157,595, filed on Mar. 21, 2002, now Pat. No. Des. 473,904.

(51) Int. Cl.[7] ..... A63B 53/04
(52) U.S. Cl. ..... 473/349; 473/350
(58) Field of Search ..... 473/290, 291, 473/324–350; D21/747–751, 759

(56) References Cited

U.S. PATENT DOCUMENTS

| | | | | | |
|---|---|---|---|---|---|
| 2,846,228 | A | | 8/1958 | Reach | |
| 4,420,156 | A | * | 12/1983 | Campau | 473/291 |
| 4,550,914 | A | * | 11/1985 | McCallister | 473/242 |
| 5,014,993 | A | | 5/1991 | Antonious | |
| 5,048,834 | A | | 9/1991 | Gorman | |
| 5,074,563 | A | | 12/1991 | Gorman | |
| D358,188 | S | | 5/1995 | Fenton | |
| D363,332 | S | | 10/1995 | Krzynowek et al. | |
| 5,562,551 | A | * | 10/1996 | Rife | 473/291 |
| 5,658,209 | A | * | 8/1997 | Blakemore | 473/350 |
| 5,669,824 | A | | 9/1997 | Aizawa et al. | |
| 5,707,302 | A | | 1/1998 | Leon et al. | |
| D394,290 | S | * | 5/1998 | Best et al. | D21/748 |
| 5,766,092 | A | | 6/1998 | Mimeur et al. | |
| 5,792,005 | A | | 8/1998 | Sieleman et al. | |
| D416,968 | S | | 11/1999 | Gilbert et al. | |
| D417,248 | S | | 11/1999 | Matsuo | |
| 6,077,173 | A | | 6/2000 | Stites | |
| D435,617 | S | | 12/2000 | Gilbert | |
| D437,902 | S | | 2/2001 | Persinger | |
| 6,206,790 | B1 | | 3/2001 | Kubica et al. | |
| D446,566 | S | | 8/2001 | McCabe et al. | |
| 6,482,104 | B1 | * | 11/2002 | Gilbert | 473/287 |
| 6,592,469 | B2 | | 7/2003 | Gilbert | |
| 2001/0014628 | A1 | | 8/2001 | Erickson et al. | |

OTHER PUBLICATIONS

Tour Premium Forged Irons, Precept Golf online, http://www.preceptgolf.com/products/tour_premium_irons.html. Oct. 18, 2001.

Tour Premium Forged Irons, Precept Golf online, http://www.preceptgolf.com/products/tour.premium_irons.html, Oct. 18, 2001.

* cited by examiner

*Primary Examiner*—Sebastiano Passaniti
(74) *Attorney, Agent, or Firm*—Troutman Sanders LLP; Gerald R. Boss

(57) ABSTRACT

An iron golf club head consisting of a back portion, a weight portion, and the cavity portion, which form a "multi-tier" weight distribution configuration. The cavity portion being delineated by a top segment, a toe segment, a sole segment and a heel segment. The first tier is defined by the back portion between the sole and the sole segment of the cavity portion. The second tier is defined by the weight portion, which is recessed from the back portion and is located between the sole segment of the cavity portion and a top edge that is located a predefined height above the sole segment. The third tier of the weight distribution configuration is defined by the cavity portion between the upper segment of the weight portion and the upper edge of the cavity portion.

18 Claims, 1 Drawing Sheet

CAVITY BACK GOLF CLUB HAVING A MULTI-TIERED WEIGHT DISTRIBUTION CONFIGURATION

CROSS-REFERENCE TO RELATED APPLICATIONS

This application is a Continuation-in-Part of U.S. Design, Patent Application Ser. No. 29/157,595 filed on Mar. 21, 2002 now U.S. Pat. No. D,473,904.

TECHNICAL DESCRIPTION OF THE INVENTION

The present invention is directed to a cavity-back iron golf club head and more particularly to cavity-back iron golf club head having multiple weighted tiers integrated with the cavity.

BACKGROUND

Since their introduction, cavity-back iron golf clubs have been popular with the average golfer because they have proven to be easier to play with than the traditional "blade" iron golf clubs. In cavity-back iron golf clubs, the majority of the weight is moved from the back of the golf club out toward the perimeter, thereby creating a deep recess, or cavity, within the backside of the golf club. Moving the majority of the weight out toward the perimeter of the golf club increases the playability of the club for the average golfer in two ways. First, moving the majority of the weight toward the perimeter of the golf club expands the "sweet spot" of the golf club, which provides better results from "off center" hits. The sweet spot is determined by the center of mass of the iron golf club head and is ideally centrally located on the face portion of the iron golf club head. Secondly, the majority of the weight is relocated to the sole portion of the club, thereby increasing the effective loft of the golf club, which makes it easier for the average golfer to get the golf ball airborne.

Although cavity back iron golf clubs have become very popular with the average golfer, better, or low handicap, players have resisted from switching from the traditional blade-type irons to cavity back irons for several reasons. First, because the majority of the mass of the iron head has been removed from behind the sweet spot, cavity back irons provide less feedback from striking the golf ball, or "feel," which is important to the low handicap golfer. Secondly, because most of the mass is moved to the sole portion of the iron head, conventional cavity back iron golf clubs tend cause a golf ball to have a much higher launch angle than that of conventional "blade" iron golf clubs favored by better golfers.

Therefore, there is a continuing need for a cavity back golf club that has a unique weighting distribution configuration that provides the large sweet spot and playability of conventional cavity back golf clubs while maintaining the "feel" and launch angle of traditional "blade" iron golf club heads.

SUMMARY OF THE INVENTION

Generally described, the invention includes a cavity-back iron golf club head that has a three-tiered weight distribution configuration integrated within the cavity of the iron head. More particularly, the invention describes an iron golf club head that is defined by a face portion, a sole portion, a back portion, and a cavity portion located proximate to the back portion. The cavity portion contains a top segment, a toe segment, a heel segment, and a sole segment. The sole segment is located at the intersection of the back portion and the cavity portion and contains a first contour. The iron golf club head also contains a weighted portion located within the cavity portion and adjacent to the back portion. The weight portion extends a predefined height upwardly into the cavity portion, which is defined by an upper segment having a second contour. The first contour along the sole segment of the cavity portion may be an arc having a first radius. The second contour along the upper segment of the weight portion may also be an arc having a second radius, which is greater than the radius of the contour along the sole segment.

Both the first and second arcs may be positioned such that the center of the arcs are located along a plane that passes through the iron golf club head's center of mass, or a ball striking portion, which is located on the face portion. Alternatively, the center of the first arc corresponding to the sole segment of the cavity may be positioned along the plane that passes through the center of mass of the iron golf club head, while the second arc corresponding to the upper segment of the weight portion, may be offset from the plane that passes through the center of mass. The center of the second arc may be shifted toward the toe portion of the iron golf club, such that the distance between the sole segment of the cavity portion and the upper segment of the weight portion is greater toward the toe portion than the heel portion.

The invention also includes a set of iron golf clubs that include long irons, middle irons, and short irons, all of which contain a face portion, a sole portion, a back portion, and a cavity portion proximate to the back portion. A top segment, a toe segment, a heel segment, and a sole segment define the cavity portion. Each iron golf club head contains a three-tiered weight distribution configuration that includes a first tier formed by the back portion of the iron golf club head, which extends from the sole portion to the sole segment of the cavity portion. The sole segment, which forms the upper portion of the first tier, has a contour, which may be an arc with a first radius and centered on the center of mass of the golf club head.

The second tier of the weight distribution configuration is formed by a weight portion that is recessed from the first tier and extends upward from the sole segment a predefined distance above the first tier. The top of the weight portion is defined by an upper segment that has a second contour. The second contour may be an arc with a second radius that is greater than the first and may be offset from the center of mass toward the toe portion.

Lastly the third tier of the weight distribution configuration is recessed from the second tier and formed by the contour of the upper segment of the second tier weight portion and the top segment of the cavity portion.

The various aspects of the present invention may be more clearly understood and appreciated from a review of the following detailed description of the disclosed embodiments and by reference to the appended drawings and claims.

DETAILED DESCRIPTION OF THE EMBODIMENTS

The present invention is typically embodied in a cavity-backed iron golf club head that includes a unique multi-tiered weight distribution configuration. The iron golf club head contains three-tier weight distribution system integrated within the cavity portion of the iron golf club head. The unique configuration of a three-tier weight distribution configuration combines the playability of a conventional cavity back iron golf club head with the "feel" and characteristics of a traditional "blade"-type iron golf club head. The multi-tier cavity back iron golf club is defined by a top portion that contains a declined face portion for striking a golf ball, a top portion, toe portion, a heel portion, and a sole portion.

Figure 1:
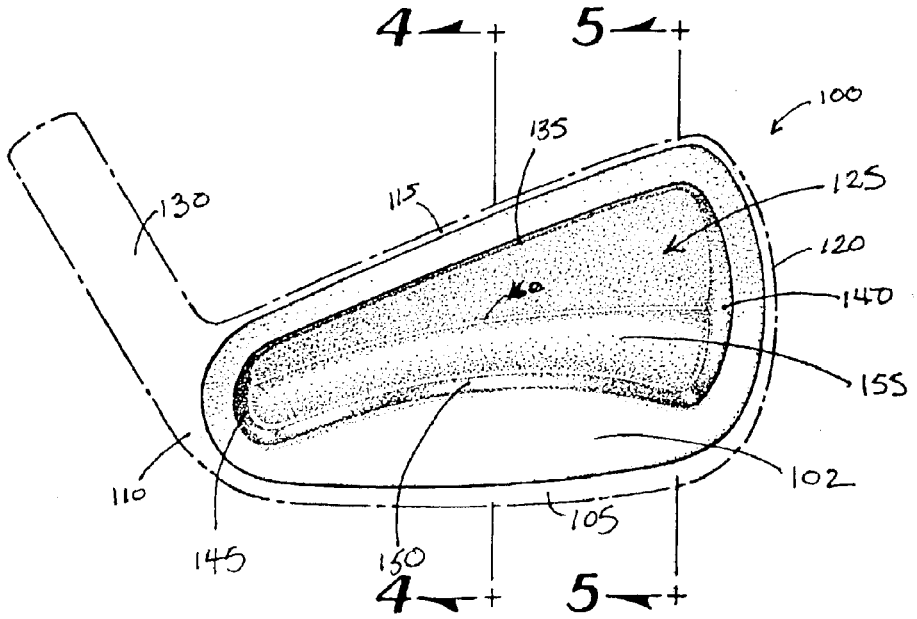
FIG. 1 is a rear elevational view of iron golf club head in accordance with the invention.

Turning now to the figures, in which like numerals refer to like elements through the several figures, FIG. 1 is a rear elevational view of the iron golf club head 100 in accordance with the present invention. The iron golf club head 100 consists of a back portion 102, a sole portion 105, a heel portion 110, a top portion 115, a toe portion 120, and a cavity portion 125. The iron golf club head 100 also contains a rewardly declined face portion (not shown) which is located proximate opposite of the back portion 102. The face portion contains a ball striking portion (not shown), which is used for striking a golf ball. A hosel portion 130 connects the iron golf club head 100 to a golf club shaft. Typically, the iron golf club head 100 is made through forging steel, such as 1025 carbon steel, aluminum, metallic alloys and the like. Alternatively, the iron golf club head may be made by casting metallic steel or any suitable metallic alloy, such as beryllium copper and the like.

The cavity portion 125 is located on the proximate to the back portion 102 of the iron golf club head 100 and is defined by a top segment 135, which runs approximately parallel to the top portion 115, a toe segment 140, a heel segment 14S, and a sole segment 150. The cavity portion 120 allows a majority of the overall weight of the iron golf club head 100 to be concentrated toward the outer perimeter, thereby increasing the size of the ball hitting portion, or "sweet spot" on the declined face portion. Increasing the size of the ball hitting portion reduces the moment of inertia, or twisting effect, experienced by the iron golf club head 100 during the striking of a golf ball, which makes the iron golf club head 100 easier for the average player to hit.

However, by reducing the weight from behind the ball hitting portion on the declined face portion, the amount of "feel," or feedback, provided to a golfer is greatly reduced. Therefore, in the exemplary embodiment of the iron golf club head 100, the sole segment 150 of the cavity portion 125 contains a contour that increases the amount of weight located directly behind the ball striking portion. In an exemplary embodiment, the contour of the sole segment is an arc, which is centered in line with the ball striking portion. In this configuration, the height of the contour is greatest directly behind the ball striking portion, which is located along the 4—4 line and gradually tapers toward the heel portion 110 and the toe portion 120. In this manner, a greater amount of mass can be concentrated behind the ball striking portion, thereby providing greater feedback to the golfer while still maintaining a large "sweet spot." Although the exemplary embodiment of the iron golf club head 100 describes the contour as an arc, other contours such as a trapezoid, a triangle, a rhomboid, or any other geometric shape may be used that concentrate mass behind the ball striking portion. Additionally, in the exemplary embodiment, the contour on the sole segment 150 extends continually along the length of the sole segment 150. Thus, in the preferred embodiment, the arc of the sole segment 150 extends from the heel segment 110 the toe segment 120. In an alternative embodiment, the contour may only extend for a portion of the sole segment 150.

The cavity portion 120 also contains a weight portion 155, which extends between the sole segment 150 and an upper segment 160 that is intermediary between the sole segment 150 and the top segment 135 of the cavity portion 125. The upper segment 160 of the weight portion 155 contains a second contour. In the preferred embodiment, the second contour is a second arc that has a second radius that is greater than the first radius of the first arc of the sole segment 150. The center of the second arc may also be positioned in line with the ball striking portion. In this configuration, the center of the radius is located along the 4—4 line and gradually taper toward the heel portion 110 and the foe portion 120. The tiered weight portion 155 provides several advantages over traditional cavity back golf clubs. First, the additional weight behind the ball striking portion further increases the "feel" of the iron golf club head 100, which is preferred by better players. Second, placing the weight above the sole segment 150 of the cavity portion 125, raises the center of mass of the iron golf club head, which reduces the "effective loft" of the golf club and produces a lower ball trajectory than conventional cavity-back iron golf club heads.

Alternatively, the radius of the arc of the upper segment 160 of the tiered weight portion 155 may be offset from the center of the ball striking portion, i.e. the 4—4 line to alter the dynamics of the iron head golf club 100. For example, the radius of the arc may be shifted toward the toe portion 120, thereby adding more weight to the toe portion 120 while reducing the amount of weight toward the heel portion 110. Thus, the height of the upper segment 160 above the sole segment 155 will be greater toward the toe portion 120 than toward the heel portion 110. The additional weight toward the toe portion 120 reduces the rotational force of the iron head golf club 100 about the 4—4 line, which allows the toe portion 120 of the iron head golf club to move slower than the heel portion 110. Shifting a greater percentage of the weight portion 155 toward the toe portion 120 is typically reserved for the shorter irons, such as a eight iron, a nine iron, and the wedges, which are usually easier for average golfers to "square up." For instance, it is known that average golfers tend to over rotate or close the face portion of the golf club, causing the face portion to or point to the left of the intended line of flight of the golf ball for a right-handed golfer (pointing to the right of the intended line of flight of the golf ball for a left-handed golfer), resulting in a the golf ball flying to the left of the target. The decreased rotational force allows average golfers to keep the face portion of these clubs square to the intended line of flight of the golf ball producing a more solid contact and straighter flight of the golf ball.

Alternatively, the radius of the second arc may be shifted from the center of the ball striking portion toward the heel portion 110, thereby increasing the amount of weight in the weight portion 140 toward the heel portion 110 and reducing the amount of weight of the weight portion 155 toward the toe portion 120. The additional weight toward the heel portion 110 increases the rotational force of the iron head golf club 100 about the 4—4 line, which causes the toe portion 120 to move faster than the heel portion 110 about the axis passing through the 4—4 line. Shifting the majority of the weight portion toward the heel portion 110 is typically performed on the longer irons, such as the one iron to the four iron. The average golfer has a difficult time "squaring up" the long irons, and as a result the leaves the face portion "open," or pointing to the right of the intended target line for a right-handed golfer (left of the intended line of flight for a left-handed golfer). Increasing the rotational forces of these clubs aids the average golfer in squaring the face portion, which results in a more solid contact of the golf ball.

Figure 2:
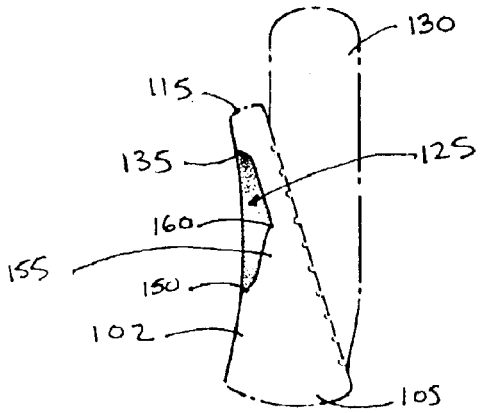
FIG. 2 is cross sectional view of an iron golf club head taken along the 4—4 line in FIG. 1 in accordance with the invention.
Figure 3:
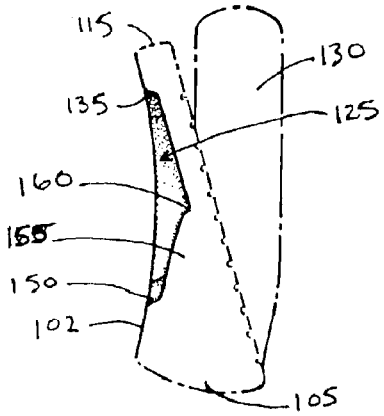
FIG. 3 is a cross-section view of an iron golf club head taken along the 5—5 line in FIG. 1 in accordance with the invention.

FIG. 2 and FIG. 3 show a cross-section view of the iron golf club head 100 taken along the 4—4 line and the 5—5 line, respectively shown in FIG. 1.

Thus, as is shown in FIGS. 1 through 3, the back portion 102, the weight portion 155, and the cavity portion 125 form a "multi-tiered" weight system. In the exemplary embodiment, the first "tier" is defined by the back portion 102 between the sole portion 120 and the sole segment 150 of the cavity portion 125. The second tier is defined by the weight portion 155, which is recessed from the back portion 102 and has a bottom edge that is defined by the sole segment 150 and the top edge 160 that is located a predefined height above the sole segment 150. The third tier of the weight distribution configuration is defined by the cavity portion 125 between the upper segment 160 of the weight portion 155 and the upper edge 135 of the cavity portion.

The invention also includes a set of iron golf club heads that include long irons (no. 1 through no. 4 irons), middle irons (no. 4 to no. 7 irons), and short irons (no. 8 to pitching wedge and sand wedge, and utility wedge), all of which contain a back portion 102, a sole portion 105, a heel portion 110, a top portion 115, a toe portion 120, and a cavity portion 125 proximate to the back portion 100. The cavity portion 125 is defined by a top segment 135, a toe segment 140, a heel segment 145, and a sole segment 150. Each iron golf club head 100 contains the three-tier weight distribution configuration that includes a first tier portion formed by the back portion 102, which extends from the sole portion 120 to the sole segment 150 of the cavity portion. The sole segment 150, which forms the upper portion of the first net, has a contour, which is a first arc with a first radius and centered on center of mass of the iron golf club head 100. The second tier is formed by a weight portion 155 that extends from the sole segment 150 to a position located intermediate to the sole segment 150 and the top segment 135 and defined by an upper segment 160. The upper segment 160 contains a contour, which is a second arc that has a second radius, which is offset from the center of mass toward the toe portion 120, Thus, the height of the upper segment 160 above the sole segment 155 will be greater toward the toe portion 120 than toward the heel portion 110. The third tier of each iron golf club head is formed by the cavity portion 125 and extends between the upper segment of the weight portion 155 and the top portion 115.

In another embodiment, the amount of offset that the center of the second arc from the center of the striking portion denoted by the 4—4 line may vary between the long irons, the middle irons and the short irons. For example, the center of the second arc associated with the upper segment 160 of the weight portion 155 may be offset from the 4—4 line toward the heel portion 110 for the long, which positions the majority of the mass of the weight portion 155 between the heel portion 110 and the striking surface. In the middle irons, the center of the second arc may coincide with the 4—4 line; place the majority of the mass of the weight portion 155 directly behind the striking portion. Finally, in the short irons, the center of the second arc of the upper segment may be shifted toward the toe segment 120 so that the majority of the mass of the weight portion 155 is positioned between the striking surface and the toe portion 120. In this manner the tiered weigh distribution system produces a "flow" weight configuration so that the majority of the mass of the weight portion 155 progresses from the heel portion 110 in the long irons toward the toe portion 120 in the short irons.

Other alternative embodiments will become apparent to those skilled in the art to which an exemplary embodiment pertains without departing from its spirit and scope. Accordingly, the scope of the present invention is defined by the appended claims rather than the foregoing description.

We claim:

1. An iron golf club head, comprising:

a face portion;

a sole portion;

a back portion; and a cavity portion proximate to the back portion, comprising a top segment;

a toe segment;

a heel segment; and a sole segment having a first contour;

wherein the sole segment is located at the intersection of the back portion and the cavity portion, such that a first weight portion is formed by the back portion extending upward from the sole portion to the sole segment; and a raised weight potion located within the cavity portion extending between the sole segment and a predefined distance above the sole segment and having a second contour.

2. The iron golf club head of claim 1, wherein the first contour comprises an arc having a first radius and the second contour comprises an arc having a second radius, wherein the second radius is greater than the first radius.

3. The iron golf club head of claim 2, wherein the first arc is centrally located to a ball striking portion of the face portion and the second arc is centrally located to the ball striking portion of the face portion.

4. The iron golf club head of claim 2, wherein the first arc is centrally located centrally to a ball striking portion of the face portion and the second arc is located at a position offset from to the ball striking portion of the face portion.

5. The iron golf club head of claim 4, wherein the second contour is located at a predetermined height above the first contour, such that the height of the second contour above the first contour is greater toward the toe portion than the heel portion.

6. The iron golf club head of claim 1, wherein the first contour extends between the heel segment and the toe segment.

7. The iron golf club head of claim 6, wherein the second contour extends between the heel segment and the toe segment.

8. The iron golf club head of claim 1, wherein the iron golf club head is forged.

9. The iron golf club head of claim 1, wherein the iron golf club head is cast.

10. The iron golf club head of claim 1, wherein the first contour and second contour extend between the heel segment and the toe segment.

11. A cavity-back golf club head having a multi-tiered weight configuration, comprising:

a face portion;

a sole portion;

a back portion; and a cavity portion proximate to the back portion, comprising a top segment;
a toe segment;
a heel segment; and
a sole segment, wherein a first tier weighs portion is formed by the back portion extending from the sole portion to the sole segment of the cavity portion having a first contour;

a second tier weight portion recessed from the first tier weight portico comprising an upper segment having a second contour and extending from the sole segment located a predefined distance above the first tier weight portion; and a third tier weight portion recessed from the second tier weight portion and formed by the contour of the upper segment of the second tier weight portion and the top segment of the cavity portion.

12. The iron golf club head of claim 11, wherein the first contour comprises an arc having a first radius and the second contour comprises an arc having a second radius.

13. The iron golf club head of claim 12, wherein the second radius is greater than the first radius.

14. The iron golf club head of claim 13, wherein the first arc is centrally located to a ball striking portion of the face portion and the second arc is centrally located to the ball striking portion of the face portion.

15. The iron golf club head of claim 13, wherein the first arc is centrally located centrally to a ball striking portion of the face portion and the second arc is located at a position offset from to the ball striking portion of the face portion.

16. The iron golf club head of claim 11, wherein the iron golf club head is forged.

17. A set of iron golf club heads, comprising a plurality of long irons, a plurality of middle irons, and a plurality of short irons, wherein each of the plurality of long irons, middle irons, and short irons comprise:

a face portion;

a sole portion;

a back portion; and a cavity portion proximate to the back portion, comprising
a top segment,
a toe segment;
a heel segment; and
a sole segment, wherein a first tier weight portion is formed by the back portion extending from the sole portion to the sole segment of the cavity portion, and the sole segment being an arc having a first radius centered on the center of mass of the iron golf club head;

a second tier weight portion recessed from the first tier weight portion comprising an upper segment, the upper segment being an arc with a second radius and extending from the sole segment to a predefined distance above the first tier weight portion, wherein the center of the second arc is offset from the center of mass of the iron golf club head toward the toe portion for each of the plurality of irons; and a third tier weight portion recessed from the second tier weight portion and formed by the contour of the upper segment of the second tier weight portion and the top segment of the cavity portion.

18. An iron golf club head comprising:

a face portion;

a sole portion;

a back portion; and a cavity portion proximate to the back; portion, comprising and
a top segment;
a toe segment;
a heel segment; and a sole segment having a first contour, wherein the first contour comprises an arc having a first radius centrally located to a ball striking portion of the face portion; and a raised weight portion located within the cavity portion extending between the sole segment and a predefined distance above the sole segment and having a second contour, wherein the second contour comprises an arc having a second radius located at a position offset from to the ball striking portion of the face portion, wherein the second radius is greater than the first radius.

* * * * *